US005214951A

United States Patent [19]

Waddell

[11] Patent Number: 5,214,951

[45] Date of Patent: Jun. 1, 1993

[54] METHOD AND APPARATUS FOR CONTROLLED BENDING OF STRIP STOCK

[76] Inventor: Thomas T. Waddell, 2918 R.R. 620-S. #108, Austin, Tex. 78734

[21] Appl. No.: 879,775

[22] Filed: May 6, 1992

[51] Int. Cl.[5] ..... B21D 22/10

[52] U.S. Cl. ..... 72/465; 72/60; 72/297

[58] Field of Search ..... 72/465, 466, 478, 296, 72/60, 297, 413

[56] References Cited

U.S. PATENT DOCUMENTS

| | | | |
|---|---|---|---|
| 2,143,442 | 1/1939 | Kellogg | 72/466 |
| 2,868,264 | 1/1959 | Jones | 72/465 |
| 2,889,864 | 6/1959 | Bowser, Jr. | 72/465 |
| 3,417,601 | 12/1968 | Werner | 72/465 |

FOREIGN PATENT DOCUMENTS

| | | | |
|---|---|---|---|
| 0097426 | 6/1983 | Japan | 72/466 |

*Primary Examiner*—David Jones
*Attorney, Agent, or Firm*—James L. Jackson

[57] ABSTRACT

A method and apparatus for accomplishing controlled bending of elongate strip stock, such as window frame strip stock, for example. An elongate flexible die is utilized having a plurality of elongate die strips including an inner laminant having considerable beam strength. The die strips and the inner laminant are composed of a flexible polymer material or any other suitable flexible material which are retained in assembly about the strip stock to be bent by a plurality of closely spaced clamps. The elongate strip stock is confined by the flexible die along substantially its entire length during all phases of its bending and forming about a substrate having a bending surface of desired configuration. The strip stock is maintained in lateral restraint as it is formed along with the flexible die to the desired configuration that is determined by the configuration of the substrate, thus preventing lateral deflection, scalloping, or other undesirable structural deformation of the strip stock as it is bent and formed to its desired configuration. Conceptually therefore, the essence of the invention is accomplished by an elongate flexible die for confining the strip stock along its entire length and having an inflexible external case which is segmented to permit bending and having an inner laminant having sufficient beam strength to provide for continuity of strip curvature.

26 Claims, 4 Drawing Sheets

METHOD AND APPARATUS FOR CONTROLLED BENDING OF STRIP STOCK

FIELD OF THE INVENTION

This invention relates generally to the bending and forming of strip stock such as metal, particularly extruded aluminum, wood, polymer and other strip stock to achieve desired twist and wrinkle resistant bending and forming thereof to desired configurations.

More particularly, the present invention relates to a method and apparatus for accomplishing controlled bending and forming of various types of strip stock to obtain twist and wrinkle free lengths thereof particularly for use in various types of construction industries.

BACKGROUND OF THE INVENTION

In the construction industry for commercial and residential buildings it is often desirable, especially for decorative purposes, to provide artfully curved and configured structural pieces or moldings. Particularly in the aircraft industry and to some extent in the automobile industry, it is desirable to provide smoothly curved structural members that enhance the development of controlled aerodynamic construction of aircraft and automobiles. Particularly in the construction industry for commercial buildings and enhanced grades of residences, it is desirable to provide windows having curved upper portions, sometimes of arcuate configuration, and in many cases of a substantially elliptical configuration, where, for decorative and structural purposes, the windows and doors may have a form of multiple varying curvature, perhaps incorporating sections of curvature of differing radii or being of varying curvature throughout the entire length thereof.

Historically, curved windows and doors have been manufactured for an extensive period of time, typically having the window frame portions thereof composed of wood that has been formed by any number of differing processes. More recently, aluminum door and window frame molding has been developed to thus provide for reasonably low-cost windows and doors having relatively low maintenance requirements. Where, for decorative purposes, such aluminum windows and doors are desired to have an artfully curved configuration, for example, of arcuate or substantially elliptical configuration, it is desirable to achieve controlled bending of straight aluminum strip stock which has been previously painted or otherwise coated to achieve a desired color and appearance. Aluminum strip stock for straight and curved window configurations is commercially available in any of a number of cross-sectional configurations, some of which are of very exotic design. To place or secure window and door frames, they are typically secured in position by means of screws, nails, staples, etc. Accordingly, the extrusions are provided with nail fins which are typically fairly thin and are easily penetrated by nails, screws and staples. In some cases certain nail flanges or nail fins are capable of being readily broken away so as to render the window or door frame convertible to different types of installations. Where curved or elliptical door or window frames are desired, it must be possible to achieve controlled bending of the strip stock without in any way distorting or tearing break-away nail fins.

Strip stock for any one of a number of different purposes is formed by bending it to a desired configuration by means of three basically acceptable processes, i.e., stretch-forming, forming by means of roll benders and bending through the use of eutectic alloys.

Although stretch forming is widely utilized for the bending of metal aircraft components, the cost of metal forming machines and their toolings, and the time required for special sizes, typically rule out this method for the window industry. Further, stretch-forming typically causes the material being formed to be necked-down, i.e., non-uniformly reduced in dimension, thus causing the resulting curved or formed product to have loss of dimensional quality. In the window industry where the extruded and painted strips being formed are of small or thin cross-sectional configuration and typically require interfitting of parts, a resulting condition of necking-down of material can not be tolerated. Loss of dimensional quality of the strip material will typically be clearly evident in the resulting product purchased by the ultimate consumer. Basically, stretch-forming occurs by placing the member being bent in tension and applying sufficient tensional force to remove any wrinkles or unusual distortion that is formed in the strip material during the bending process. Further, the stretch-forming process typically induces significant hardening of the strip stock material during bending. In the aircraft industry, bent parts may be annealed, i e., softened, after having been formed. Thus, the resulting annealed, bent or formed product has no particularly enhanced tendency for stress or wear damage during service. In the window industry, the strip stock is typically painted or coated prior to bending. Thus, the resulting bent or formed strip material can not be annealed after it has been formed. In essence, stretch-forming is a process for achieving bending of strip stock that can not be employed by the window industry for the development of curved or elliptical window frame components.

The process that is currently utilized for the forming of curved or elliptical window frame components is the roll forming process. The coated strip stock is passed through a roll forming assembly where it is formed to a curved configuration by passing it through a forming roll assembly. Although roll benders such as C.N.C. Roll Benders can be successfully operated for the forming of curved door and window components, the costs of these types of machines is typically extremely high. Further, it is necessary to have experienced operators with extensive operator skills in order to achieve satisfactory results. Consequently, labor costs for controlled bending of door and window components is extremely high. It is also well known that repeatability of the bending process is quite poor. It is difficult to achieve roll forming of successive aluminum strip stock and yet have the resulting curved product be precisely the same as another that is bent using the same strip stock and the same bending roll setting. For efficient commercial window and door manufacturing operations, it is necessary that the bending process achieve bending results that are duplicated. As mentioned above, the strip stock being bent is typically painted while in its straight form. For the resulting product to be of quality nature it is necessary that the paint on the strip stock not be damaged by scuffing, flaking, etc. It has been determined that significant damage to the finish of the material is often the result of many metal strip roll forming processes. This is an intolerable condition in the window industry because the resulting product must be aesthetically pleasing to the purchasing customer.

It should be born in mind that aluminum strip stock for the window industry has variable hardness, with hardness variations between batches of strips and with differing hardness from strip to strip within batches of strips. Hardness variation accentuates the strip bending problems that are encountered. With roll forming machines it has been determined that the strip material being bent is not only formed by contact with the rolls but it is also formed between the various rolls by the forces that occur. When the material is formed between the rolls it is not supported in any manner whatever. The resulting finished product can therefor be twisted or its curvature may vary from the curvature that is desired. The variations in material hardness that are encountered accentuate and amplify the roll bending problems that are encountered primarily because the bending being accomplished at any given time is confined to a very short length of the strip material. The roll forming process also causes extensive work hardening of the material being bent. For example, strip stock with a hardness of T-3 can easily be hardened to a hardness level of T-16 during the roll forming process. Because the strip stock has been significantly work hardened to this extent, if the resulting product varies slightly from the intended curvature for which the bending machine is set, the material will have work hardened to the extent that it can not be further formed. In this case, the material simply becomes scrap. High scrap rates are typical when aluminum strip stock for windows is being roll formed for arcuate or elliptical window frames.

It is also well known that expensive three roll die sets are necessary to accomplish forward, reverse and bow bends in aluminum strip stock. Although the roll bending machines are of quite expensive nature and the dies are significantly expensive, no manufacturer of these types of machines will provide a guarantee of success in the use of a machine or dies. Thus, many purchasers of the machines and dies can, and frequently do, produce a substantial quantity of scrap metal while attempting to set the machine up for a particular strip stock bending process. It is desirable therefore to provide a process and apparatus for accomplishing controlled bending of metal strip stock which is capable of producing designed, curved or elliptical components for windows, doors and the like without damaging the paint or coating of the strip stock and without wasting a considerable amount of the strip stock in order to achieve bending thereof. It is also desirable to provide a bending process and apparatus that achieves efficient, controlled and repeatable bending of strip stock such that any number of completed curved window or door components may be prepared in a short period of time.

Eutectic alloys are utilized in the bending of metal strips by initially suspending the strip within an elongate trough. Eutectic alloy in its molten or liquid state is poured into the trough so as to completely encompass the strip material to be bent and is then caused to solidify. Because the eutectic alloy becomes brittle when it solidifies, it must be quenched to permit its bending. The quenching step actually anneals the eutectic alloy to prepare it for bending. After its annealing and removal from the elongate trough, the annealed eutectic alloy with the strip material encapsulated therein is bent about a suitable form or is bent by passing it through bending rolls. After the bending process has been completed, the eutectic alloy is then again reduced to its molten state and is separated from the bent metal strip. One of the principal disadvantages of this bending process is that a small amount of the very expensive eutectic alloy remains on or in the strip stock. The loss of this expensive alloy has a significant disadvantageous impact on the cost of the bending process. Further, in some cases, it is necessary to insure removal of all of the eutectic alloy. In these cases cleaning of the bent strip stock can be quite expensive. Also, secondary bending of the eutectic alloy is not normally possible because it work hardens and again becomes brittle as it is bent. A further disadvantage, the equipment that is necessary to melt, fill, recapture, quench and handle the eutectic alloy is quite expensive and is also considered to be quite hazardous to worker personnel. All of these features render the use of eutectic alloys for the bending of metal window stock to be disadvantageous to the extent that it is impractical for the metal window industry.

Although much of the discussion in this patent concerns the controlled bending of strip stock material for windows, doors, and the like for commercial and residential buildings, the principles of this invention are equally effective for bending aluminum and other strip materials for the aircraft industry, the automotive industry, etc. Moreover, the principles of the present invention are applicable to the bending or otherwise forming of materials other than metal. For example, wood bending (laminating) equipment and equipment for laminating and forming of polymer materials may be effectively utilized within the scope of the present invention.

SUMMARY OF THE INVENTION

It is a principle feature of the resent invention to provide a novel method for accomplishing controlled bending and forming of strip stock, such as metal strip stock and to yield a formed product that is free of twisting or wrinkling and which is substantially free of surface damage or distortion as a result of the bending process.

It is also an important feature of this invention to provide a novel method of accomplishing controlled bending of strip stock by confining the strip stock against lateral movement along substantially its entire length and to accomplish bending of the strip stock while it is thus confined, thus yielding a finished bent product of designed curvature and configuration.

It is another feature of this invention to provide a novel process for achieving controlled bending of strip stock wherein the strip stock is placed within a flexible die and is bent about a substrate of designed configuration, the strip stock being bent while maintained under lateral restraint along substantially its entire length during all phases of the bending process.

It is an even further feature of this invention to provide a novel apparatus for achieving controlled bending of strip stock which incorporates an elongate flexible bending body or die that is capable of being formed about a bending substrate and which forms an internal elongate die chamber for receiving the strip stock in intimate relation therein and for confining the strip stock material within predetermined parameters of linear and lateral movement at all times during the bending process thereof.

It is also a feature of this invention to provide novel apparatus for achieving controlled bending and forming of metal strip stock in which the strip stock may take on a substantially helical configuration with three dimensional components of bending as the result of the bending process of this invention.

It is another feature of this invention to provide a novel process and apparatus for achieving controlled bending of metal strip stock which achieves molecular flow of the metal across the neutral axis of the strip stock during the bending process and thereby minimizes work hardening of the strip stock during bending and forming thereof.

It is also a feature of this invention to provide a novel method and apparatus for bending metal strip stock wherein force vectors being applied to the strip stock are controlled such that the metal strip stock receives only those force vectors that achieve its bending to a suitable curvature and form.

Briefly, the principles of the present invention are achieved by a method or process of twist and wrinkle resistant forming of strip stock such as metal strip stock to a desired curvature and configuration. The method is achieved by providing a bending substrate having a forming surface of a desired configuration, the bending substrate being supported in fixed relation by any suitable support. The strip stock to be bent and formed is encapsulated within an elongate flexible and separable forming body defining an elongate internal die cavity having a cross-sectional configuration substantially conforming to the cross-sectional configuration of the strip stock. The elongate flexible forming body is composed of flexible and substantially incompressible material such as ultra high molecular weight polyethylene or any other suitable material that is of flexible, substantially incompressible nature, having a density approaching that of the metal being bent and having a self-lubricating quality. If the bending strips and the inner laminant are composed of a non-self-lubricating material, they may be coated with a self-lubricating material such as polytetrafluoroethylene or provided with a suitable lubricant. The elongate flexible die also includes an elongate inner lamination of dense, flexible material which provides sufficient structural integrity on the concave side of the strip stock to prevent faceting or scalloping of the inner curvature of the resulting strip stock. After the strip stock has been suitably confined by the flexible forming body sufficient force is applied to accomplish bending of the flexible forming body to the configuration of the forming surface of the bending substrate. Thus the forming substrate is of a configuration and dimension to permit forming of the strip stock to its desired configuration and to compensate for the "spring-back" which is inherent in the bending of metal. One suitable method for accomplishing bending of the forming body about the substrate may conveniently take the form of tension cables or cable bridles that are attached to clamps located at the respective ends of the flexible forming body and which apply force to the ends of the flexible forming body at appropriate angles to provide force application along a center line that is oriented in substantially normal relation with a center point at the center of curvature of the forming surface of the forming substrate. The cables or cable bridles are adjustably positionable relative to the support structure such as by means of a plurality of selectable tension angle control rollers. This permits the angle of force application to the respective ends of the flexible forming body to be selectively controlled by the operator of the bending machine in accordance with the particular configuration of the strip stock at any given time during the bending process. Application of force to the respective ends of the elongate flexible forming body is imparted by any suitable motor operated drive mechanism such as an electric motor operating through a gearbox transmission and drive chain mechanism, a linear hydraulic or pneumatic motor, etc.

The elongate flexible forming body or die is composed of at least two and preferably a plurality of elongate die strips of ultra high molecular weight polymer material such as polyethylene. The flexible die strips are machined or otherwise formed lengthwise so that when the same are in assembly, they cooperatively define an elongate die chamber having a cross-sectional configuration substantially conforming to the cross-sectional configuration of the strip stock. The flexible die includes an elongate inner strip or laminant of ultra high molecular weight flexible material which defines a contact surface disposed for contact with the compression side of the strip stock to be formed. As the elongate flexible forming body is subsequently bent to achieve the curvature of the forming substrate, the contact surface restrains the compression side of the strip stock that is being bent within the die cavity so that the compression side of the strip stock achieves a smoothly curved configuration and has no tendency to become wrinkled scalloped, faceted or twisted as strip forming is taking place. Preferably, the elongate flexible forming body includes a plurality of elongate die strips each being composed of flexible, ultra high density material and that are of a cross-sectional configuration which cooperatively defines the elongate die cavity when the flexible die strips are in assembly.

The elongate flexible forming body causes the strip stock to be restrained on at least three of the four axes thereof at all times during the bending process. This is achieved through the provision of flexible, dense die material in combination with a segmented rigid totally inflexible external case which is segmented to permit bending of the forming body or die. This restraining capability of the forming body provides efficient bending control and restraint on all portions of the strip stock throughout the entire length thereof at all times during the bending process. Confinement of the strip material within the flexible die during its bending prevents the development of any trend toward distortion that would ordinarily result in scalloping, rippling or faceting of the strip material. This material confinement allows the strip material to be bent over a large area rather than a small area as is the case with roll bending operations. Since the strip stock is transversely restrained in this manner during bending, the bending process induces molecular transition of the material from which the strip stock is composed across the neutral axis of the strip stock. This feature effectively minimizes work hardening of the strip stock during the bending process such that in general appearance the strip stock appears virtually undeformed in comparison to its initial cross-sectional configuration even though it may be bent to a rather small curvature, depending upon the curvature of the forming surface of the substrate. This enables the resulting bent strip stock to be additionally worked without inducing excessive work hardening of it.

The elongate flexible forming body is completed by the provision of a plurality of rigid clamps that are each secured in clamping assembly with the forming body by means of a movable clamp plate. A plurality of such clamps are positioned in closely spaced relation along the length of the forming body, with the clamps disposed to engage the forming surface of the substrate as the strip stock yields and is bent to a curvature defined by the substrate.

As the elongate forming body is bent, the die strips or laminates are permitted sliding linear movement relative to one another and relative to the strip stock. The self-lubricating capability of the laminants prevents scratching and surface abrasion of the strip stock during its bending.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

In the Drawings

FIG. 1 is a plan view of apparatus for bending and forming strip stock, showing a strip forming substrate fixed thereon and further showing an elongate flexible die positioned in strip forming relation thereon and being shown in its unflexed condition.

FIG. 2 is a partial plan view similar to that of FIG. 1 and illustrating initial bending of the elongate flexible die and the strip stock positioned therein about the forming surface of the substrate.

FIG. 3 is a partial plan view similar to that of FIG. 2, illustrating the elongate flexible die being bent to its finished position about the forming substrate.

FIG. 4 is a side elevational view of the apparatus of FIGS. 1-3.

FIG. 5 is an enlarged, cross-sectional view taken along line 4—4 of FIG. 1 and illustrating the various components of the elongate flexible forming body for achieving controlled bending and forming of a length of strip stock such as extruded strip stock.

FIG. 6 is an enlarged, cross-sectional view similar to that of FIG. 5 and representing an alternative embodiment of the present invention.

FIG. 7 is an illustration of strip material being bent and formed according to the teachings of the present invention and being interfitted with other strip stock to define window molding.

FIG. 8 is an illustration of a bending form substrate designed for use in accordance with the teachings of the present invention and illustrating substrate modification which can be accomplished during a bending procedure.

FIG. 9 is a plan view of a strip bending operation through use of the apparatus of this invention and which illustrates bending of the strip material over a long length, which is not ordinarily possible with other bending operations.

DETAILED DESCRIPTION OF PREFERRED EMBODIMENT

Figure 1:
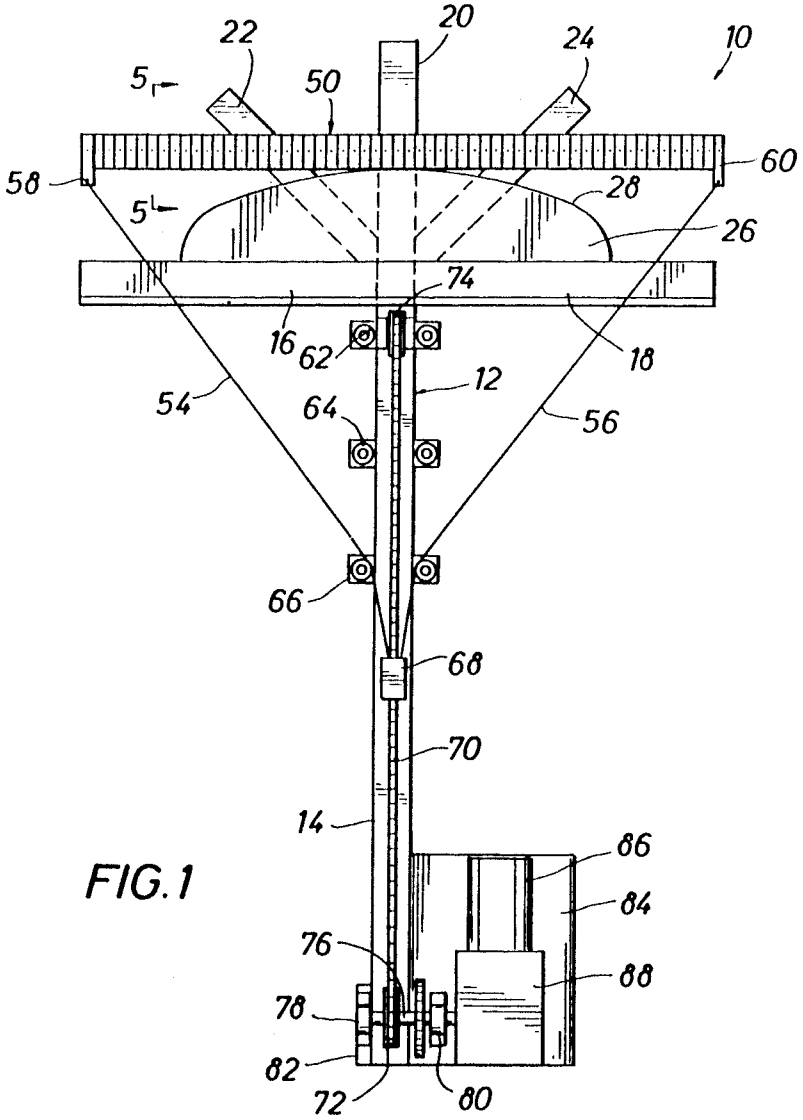
Figure 7:
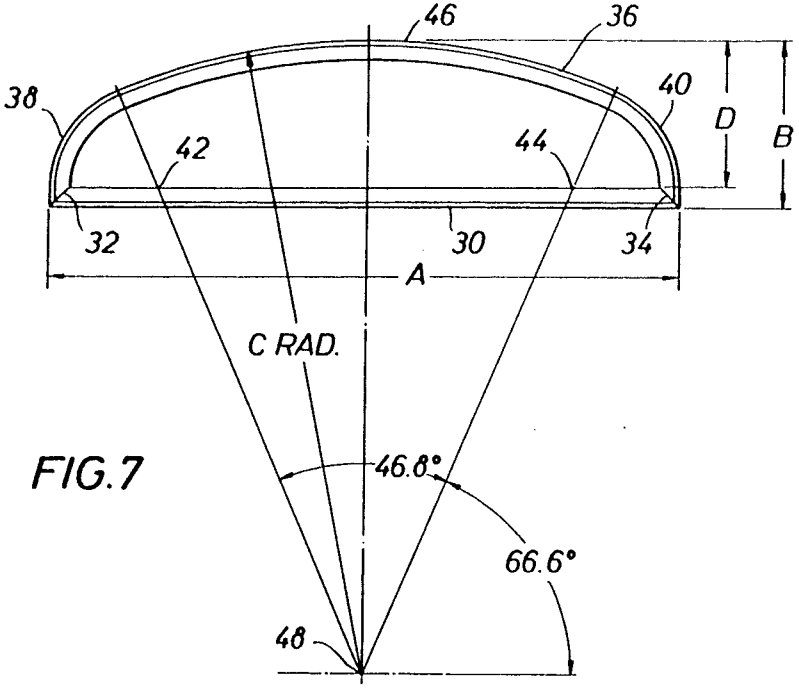

Referring now to the drawings and first to FIG. 1, a strip stock forming mechanism constructed in accordance with the teachings of the present invention is illustrated generally at 10 and incorporates a support structure shown generally at 12 which may be fixed to any suitable structure such as the floor or work bench or platform of a manufacturing facility. The support structure 12 incorporates an elongate horizontal beam 14 which is supported by a plurality of upright support standards 16 which are in turn fixed to the floor F or to any other suitable structure. The support structure 12 further incorporates a pair of opposed transverse arms 16 and 18 that are positioned in substantially normal relation with the elongate horizontal beam 14. A central support arm 20 is provided which is coextensive with the horizontal support beam 14 and which, if desired, may be integral with the beam 14. A pair of angle arms 22 and 24 are positioned in coplanar relation with the respective arms 16, 18 and 20 and are positioned to bisect the angle between these side and central arms. The arms 16–24 collectively define a support structure for supporting a strip forming substrate 26. The substrate 26 is secured to this support by any suitable means such as clamping, bolting, etc. and may be composed of any of a number of suitable materials including wood, metal, polymer, etc. The forming substrate defines a strip forming surface 28 thereon which, as mentioned above, may be of arcuate form or may be of any other suitable form defining a plurality of curved surface configurations. For example, "elliptical windows" as used in the window industry does not ordinarily mean that the curved portions of the windows define a true ellipse. Rather, elliptical windows typically have a curved portion defining a central arc of large radius and smaller arcs at opposed sides defined about a smaller radius as evidenced by FIG. 7. A representative example of a finished elliptical window is illustrated in FIG. 7 which includes a lower straight frame section 30 which is mitered at 32 and 34 to a curved frame section 36. The curved frame section is defined by smoothly merging arcs formed by arcuate side zones 38 and 40 defined about the center points 42 and 44 respectively and a larger, central arcuate section 46 defined about center point 48. Thus the curved portion 36 of the window is not elliptical in the true sense of the word but is referred to as elliptical in the window industry.

Figure 8:
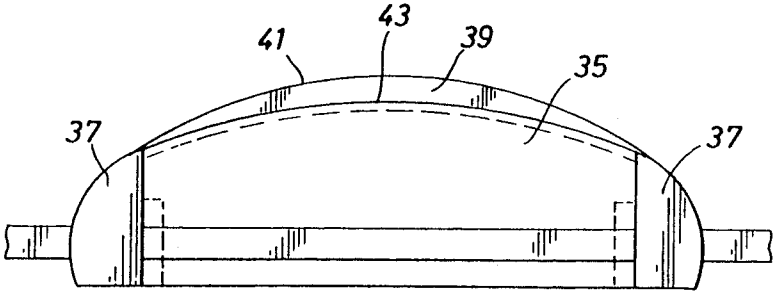

Referring now to FIG. 8, it should be born in mind that the bending substrate about which the strip stock is formed need not be an integral, fixed structure. In fact, as shown in FIG. 8, a basic substrate structure such as shown at 35 may have replaceable end structures 37 which are capable of being removably assembled to the central portion 35 thereof. Additionally, the substrate may be provided with a removable central forming section 39 having a curve forming surface 41 that is of a different configuration as compared to the forming surface 43 of the central substrate section 35. Thus, a basic substrate structure may be provided. A plurality of replaceable substrate sections such as substrate sections 37 ad 39 may be provided to thereby selectively adjust the configuration of the substrate according to any changes that are desired for bending the strip stock. For example, the strip stock may be bent about the substrate surface 43 and, during the bending process, the replaceable central substrate section 39 may be introduced to provide additional control for the strip stock. This type of strip reworking during the bending process can not ordinarily be accomplished without annealing the strip stock for further working. In the case of the present invention, however, it has been determined that additional working of the material during the bending process can be readily accomplished because minimal work hardening of the strip stock material occurs upon initial bending. In the forming of curved metal structures such as elliptical windows, very little structural deformation of the strip stock material occurs on bending. Consequently, straight and curved window sections fit together precisely.

Figure 2:
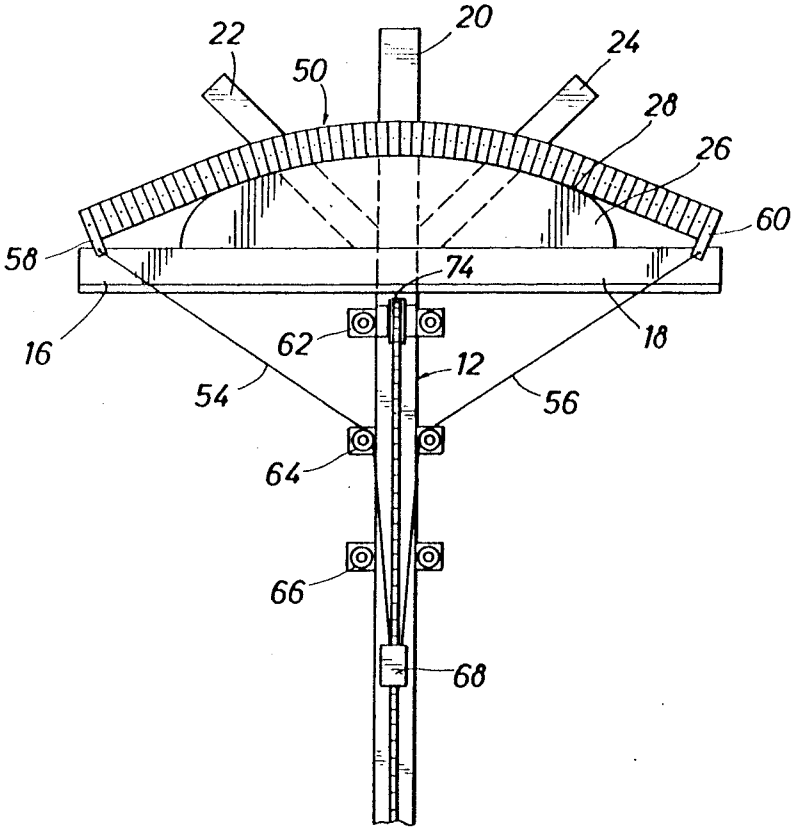
Figure 3:
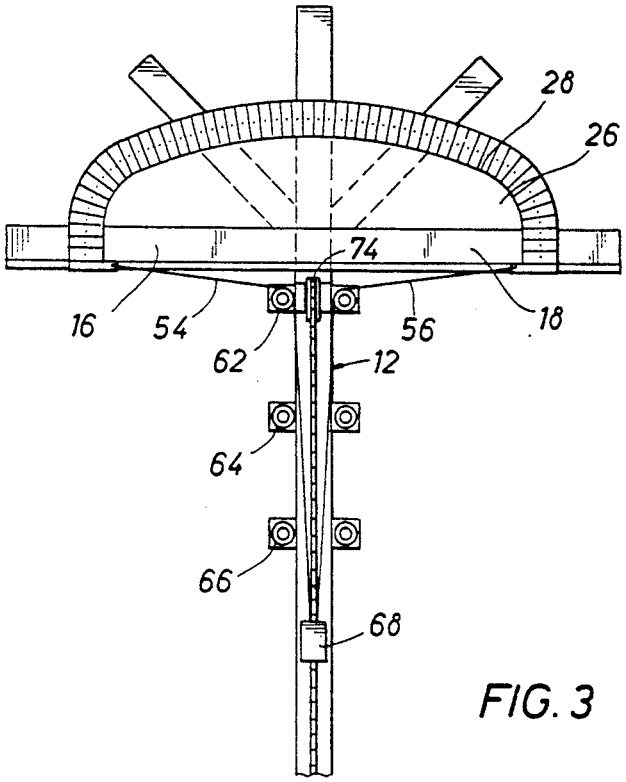
Figure 4:
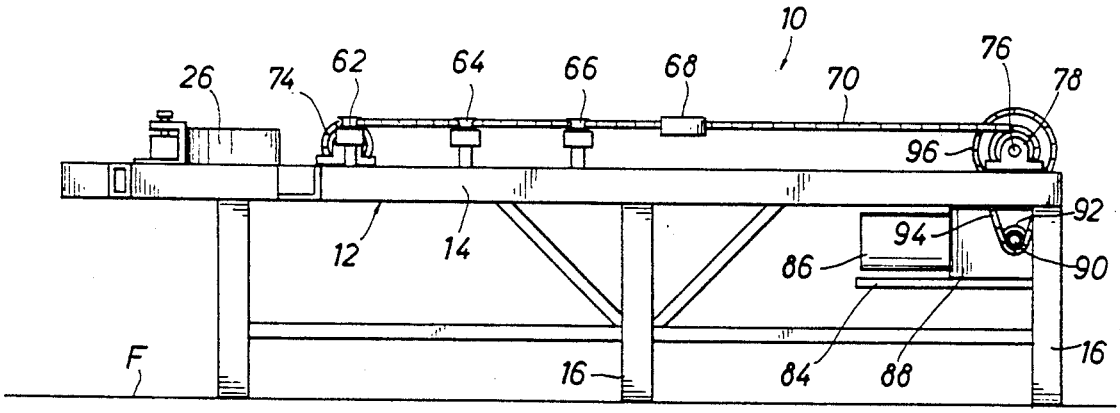

As shown in FIGS. 1-4 an elongate flexible forming body shown generally at 50 is positioned in centrally oriented, engaging relation, with the curved forming surface 28 of the forming substrate 26 nd is bent about the forming surface by laterally induced force so that when bending is finished, as shown in FIG. 3, the elongate flexible body or die is in the configuration shown in FIG. 3, and the elongate strip stock 52 located therein will have been formed to a curved condition as determined by the configuration of the substrate.

Laterally induced force is applied to the respective ends of the elongate forming body 50 by means of a force inducing cable bridle incorporating cable sections 54 and 56 which are attached to die connectors 58 and 60 which define respective extremities of the elongate flexible forming body. The cable sections 54 and 56 are positionable about respective pairs of orienting guide rollers 62, 64 and 66 that are supported by the elongate beam 14. The guide rollers are positioned in spaced relation along the beam 14 such that the cables 54 and 56 may be selectively positioned about pairs of the guide rollers to thus permit the operator to control the angle of force application to the respective ends of the flexible forming body 50. Differing cable positions are illustrated in FIGS. 2 and 3 according to the bending condition of the flexible forming body and the strip stock.

Respective ends of the cables sections 54 and 56 are secured to a linear force applying trolley 68 which is secured to a drive chain 70 which is disposed about a drive sprocket 72 and an idler sprocket 74. The drive sprocket 72 is fixed to a drive shaft 76 that is supported by pillow block bearings 78 and 80 that are supported by a mounting plate 82 that is fixed by welding, bolting or the like to the elongate support beam 48. A second mounting plate 84 is provided which is secured to the elongate beam 14 at a different elevation as compared to mounting plate 82 and provides support for an electric motor 86 and motor driven transmission 88 that are supported in fixed relation thereby. The transmission 88 is provided with an output shaft 90 to which is fixed a sprocket 92 receiving a drive chain 94. The drive chain 94 is also received about a larger driven sprocket 96 that is also fixed to the drive shaft 76. Thus, as the output shaft 90 of the transmission 88 is rotated by the electric motor 86 the drive chain 94 driven by sprocket 92 imparts rotation to the drive sprocket 96. This causes the drive chain 70 to be driven in the direction of drive sprocket rotation, thus selectively moving the trolley 6B and the cable sections 54 and 56 connected thereto in the selected direction of the drive chain. The electric motor 86 is reversible and is precisely controllable so as to provide the operator of the bending mechanism with the capability of efficiently controlling the amount of strip bending that occurs.

The bending operation typically starts with the elongate strip stock located within the flexible forming body 50 and positioned in the manner shown in FIG. 1. The electric motor 86 is then activated, thus causing the trolley 68 to be moved by the drive chain 70 toward the sprocket 72, thus imparting tension to the cable sections 54 and 56 and to the ends of the strip stock to which the cables are connected. Trolley and cable movement continues until the strip stock and the flexible forming body has been formed essentially to the condition of FIG. 2, at which point the efficiency of tension diminishes because of the then angle of the tension cables 54 and 56. The electric motor is then reversed, causing the trolley 68 to move in the opposite direction, thus loosening the cables. The operator will then shift the cables from about the cable guide rollers 66 to the cable guide rollers 64 or 62. In this manner, the angle of the cable will change to be more efficient with respect to applying tension to the ends of the strip stock to cause further bending of the strip stock and the flexible forming body. Subsequently, the direction of the trolley 68 may again be reversed, thereby loosening the tension cables such that the operator may shift the cables to guide rollers 62 thus further changing the angle of the cable such that application of bending force on the flexible forming body and its strip stock remains optimum for bending, without applying excessive force to the cables 54 and 56 and the drive chain and trolley system.

If a tension force readout is desired, the cable connection to the trolley 68 may be provided with an appropriate sensor such as a strain gauge sensor 69. The sensor will provide strain gauge signals that may be amplified and used to provide an analog readout on a suitable strain gauge meter. Also, if desired, the strain gauge signals may be appropriately digitized and utilized to provide a digital readout of the strain that is being applied to the flexible forming body through the cable bridle system at any given time.

Figure 5:
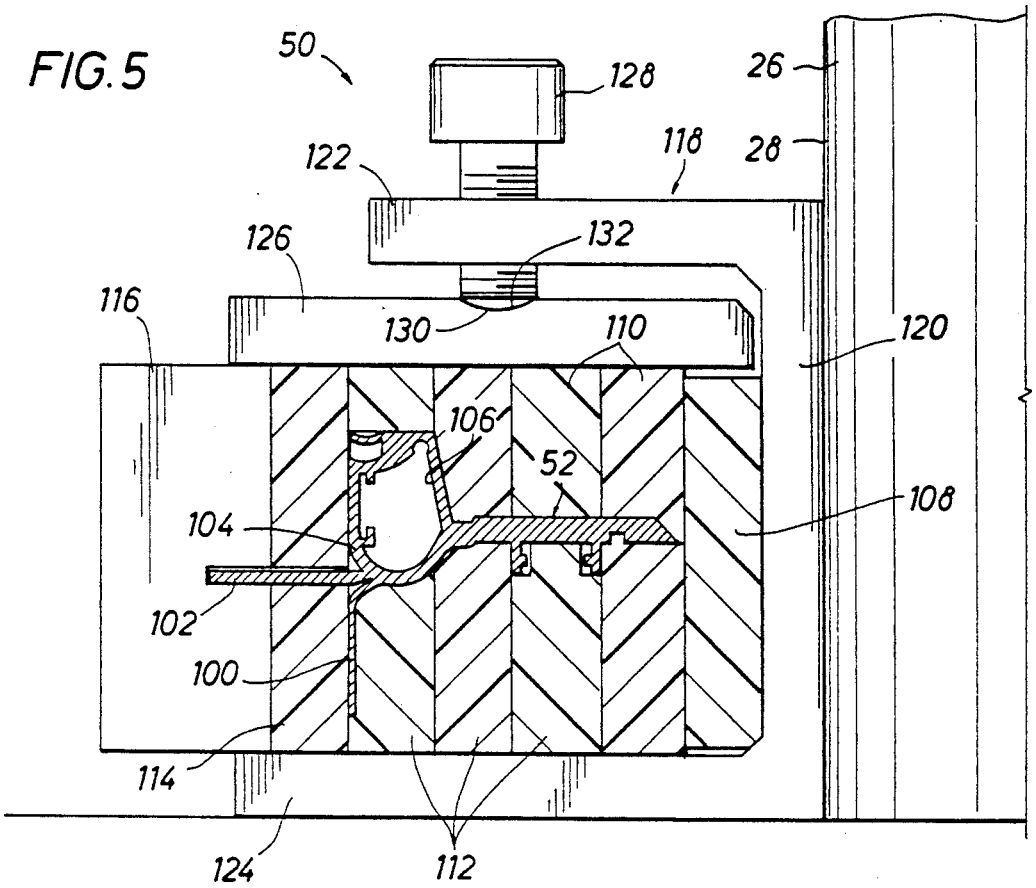

Referring now to FIG. 5, which illustrates a cross-sectional view of the elongate flexible bending body or die 50 taken along line 5—5 of FIG. 1, a representative example of an elongate strip stock is shown generally at 52. It should be born in mind that this particular strip stock is not intended to limit the present invention in any manner whatever. The strip stock is representative of the type of window frame strip stock that would be encountered in the window industry. This strip stock is typically provided in straight sections, several feet in length and is simply cut to length for straight window frame sections. A pair of nail fins or flanges 100 and 102, with nail fin 102 having a reduced cross-section at its juncture with the body portion 104 of the window molding strip stock 52 to thus define the nail fin 102 as a break-away nail fin, enabling it to be removed if desired at the time of installation. For removal, a worker will simply bend the nail fin 102 back and forth laterally, causing the reduced cross-section to fracture at its juncture with the main body 104. In the roll form bending of extruded aluminum window strip stock such as shown at 52 in FIG. 5, it is typical for the relatively thin nail flanges 100 and 102 to warp upwardly or downwardly or to take on a corrugated or scalloped form because the strip is subjected to undesired lateral force vectors during bending thereof. Additionally, the break-away nail fin will frequently become ruptured during the bending process. In these cases the strip stock must be discarded as scrap. The rather complicated configuration of this type of window strip stock causes inherent lateral forces to be induced within the strip stock during its bending, thus frequently causing the strip stock to become warped or twisted as the bending process is taking place. At the inner periphery of the bend the strip stock often becomes scalloped. These disadvantageous results occur primarily because the strip stock is unsupported during the bending process, except in the area of its line contact with the forming rolls and significant material bending occurs at the unsupported sections between the rolls.

According to the principles of the present invention, the strip stock 52 is totally confined along substantially its entire length during all phases of the bending process. This confinement is not limited to the deflection properties of the flexible material. Rather, confinement of the strip stock occurs because of the flexibility and resistance to compression that is afforded by the flexible forming body and the beam strength of the inner laminant of the forming body. For this reason, the various flanges and structural components of the strip stock can only acquire a curvature as controlled by bending of the elongate flexible forming body. Undesired lateral force vectors are prevented from acting on the strip stock. Thus, during the bending process the strip stock can not become twisted, scalloped, or otherwise deformed as the result of bending. Since the strip stock is totally confined during its bending, force vectors tending to induce lateral distortion of the strip stock are overcome by the lateral support of the flexible die and thus the strip stock can only take on the form that is controlled by bending of the flexible forming body.

For the purpose of confining the strip stock 52 and controlling its bending about the forming surface 28 of the substrate 26, a plurality of polymer strips are provided, which cooperatively form an elongate die cavity 106 within which the strip stock 52 is positioned. The elongate flexible body or die is defined by an inner bending strip or laminant 108 which is preferably composed of a substantially flat strip of polymer material such as ultra high molecular weight polyethylene. The inner bending strip or laminant 108 is of a length that exceeds the length of the strip stock being bent about the forming substrate to thus ensure application of the beam strength of the inner laminant along the entire length of the strip stock. The beam strength of the strip stock ensure continuity of the resulting curvature of the strip stock by preventing lateral distortion. The flexible die includes a plurality of upper and lower elongate die strips which are also composed of an elongate flexible material such as ultra high molecular weight polyethylene. The elongate upper die forming strips 110 and the lower die forming strips 12 are each formed to cooperatively define the internal die cavity 106 and to provide lateral support surfaces for the strip stock 52 so that the strip stock is supported against lateral deformation during the bending process. The outer portion of the flexible bending body or guide is composed of an elongate, rather thick strip of flexible material which is formed to define receptacles for receiving and supporting the nail fins 100 and 102 of the strip stock. The flexible strip 114 is kerfed as shown at 116 along its entire length to thereby provide for enhanced flexibility thereof. Kerfing of the flexible strip 114 is accomplished by forming closely spaced vertical slots in the strip stock along its entire length, thus requiring its bending along a rather small cross-section as shown at 114. The polymer stripes, including the inner laminant, which define the forming body, have a self-lubricating characteristic which protects the painted outer surface of the strip stock from excessive abrasion during bending. This feature effectively allows linear sliding of the polymer strips during the bending operation.

It is desirable to secure the flexible strips that define the die cavity in assembly and to provide enhanced structural resistance against upward movement, downward movement or movement toward the inner periphery of the bend being formed. To accomplish this feature the elongate flexible forming body includes a plurality of clamps such as shown generally at 118, each clamp defining a vertically oriented central section 120, an upper horizontal flange 122, and a lower horizontal flange 124. The flanges 122 and 124 are formed integrally with the central portion 120 of the clamp. The clamps 118 may be of any suitable width. For example, clamps having a width of approximately two inches have been found quite effective for the forming of elongate extruded aluminum window strip stock such as that shown at 52.

It is desirable to provide a restraining force against upward or downward movement of the flexible die forming strips 110 and 112 and to prevent vertical deformation of the outer peripheral strip 114. To accomplish this feature, each of the plurality of clamps of the elongate flexible forming body or die are provided with clamp plates 126 having a width substantially equal to the width of the upper and lower flanges 122 and 124. The upper flange 122 of each of the clamps defines an internally threaded aperture which receives the threaded portion of a bolt 128. The bolt defines a rounded or tapered end 130 which is received within a correspondingly configured depression 132 formed in the clamping plate 146. Thus, by rotating the bolt 128 in the tightening direction, the bolt causes the clamping plate to be urged into tight, restraining engagement with the upper surfaces of the die forming strips 110. This also causes the lower surfaces of the lower die forming strips 112 to be restrained by the horizontal lower flange 124 of each of the clamps. The inner laminant defined by the inner peripheral strip of flexible material 108 is of less height than the combined height of the die forming strips 110–112. Thus, when the clamping plate 126 is in tight, restraining engagement with the die strips, no mechanical force is applied by the clamping plate to the inner peripheral strip. This feature allows the inner peripheral strip to freely establish a smoothly curved configuration as determined by the configuration of the forming surface 28 of the forming substrate 26.

A number of clamps such as shown at 118 are located in closely spaced relation along the length of the flexible forming body and are each tightly clamped to secure the die strips in strip restraining assembly as shown in FIG. 5. Thus, along the entire length of the flexible forming body the clamps provide restraint against upward or downward movement of the elongate flexible die strips. Further, the inner peripheral bending strip or inner laminate 108 and the central portion 120 of each of the clamps provides restraint against undesirable lateral movement or lateral deformation of the strip stock as it is being formed about the substrate 26. The curved outer peripheral die strip 114 also provides for lateral restraint of the nail fin 102 and lateral bending control and restraint of the nail fin 100. As the flexible die is being bent, the surfaces defining the plurality of kerfs 116 along the length of the strip 114 ensure proper restraint of the outer peripheral portion of the strip stock as the strip stock is formed to its desired configuration. Thus, the strip stock is absolutely restrained along three axes relative to its median axis, i.e., upwardly, downwardly, and inwardly. This restraining capability of the elongate flexible forming body together with the beam strength of the inner laminant 108 effectively controls application of force vectors to the strip stock and thus prevents lateral warping or scalloping of the strip stock during its bending process by opposing force vectors that might otherwise induce trending of the material toward distortion. This causes the resulting bent strip stock to be free of lateral distortion and causes it to have continuity of curvature throughout its length.

As the result of its confinement during bending, there is induced a molecular transition of the material from which the strip stock is formed across the median line of the strip stock. This feature permits rather tight bending of the strip stock, without causing the strip stock to be excessively cold worked and hardened. For this reason the hardness increase of aluminum strip stock for the window industry will have a range of from about T-3 to about T-6 as compared to roll forming of the same strip stock which causes a hardness increase of from about T-3 to about T-16. For this reason, it has been found that this type of strip stock, having been bent to a desired configuration, can be subjected to additional bending processes without material increase in the hardness of material. This minimal work hardening allows the material to be worked to perfection by additional bending. Variations in the initial hardness of the strip stock can be readily accommodated according to the scope of the present invention. In the case of roll forming strip stock of this nature, the initial hardness increase is significantly great that additional roll forming can not be successfully accomplished. Further, if excessive bending results, roll formed strip stock is almost impossible to straighten by reworking. Twisting is the typical result.

Figure 9:
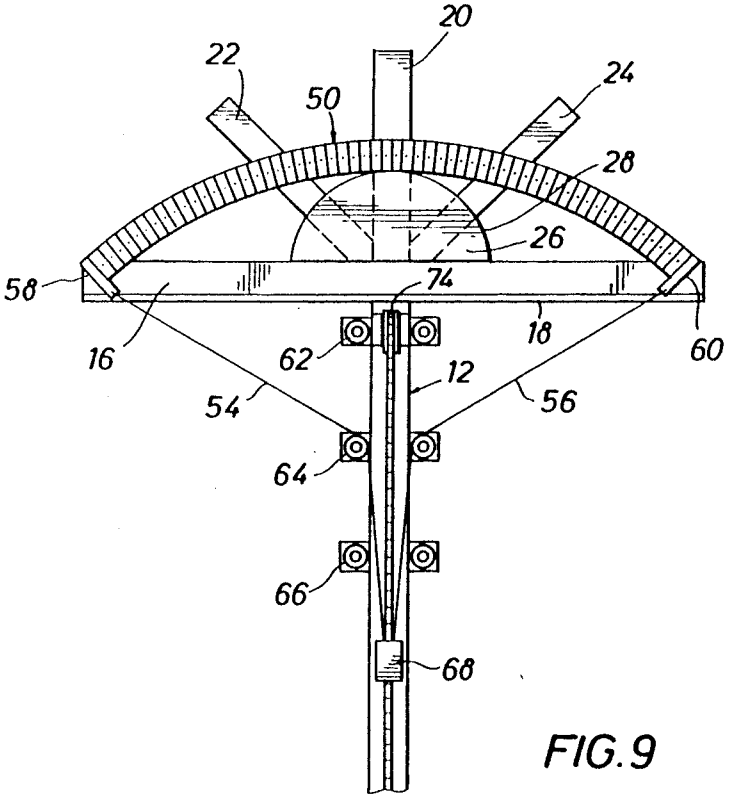

Significant work hardening of the strip material occurs during roll forming because the rolls have line contact with the strip material, i.e., small contact area, so that bending of the strip material occurs immediately adjacent the rolls and thus is confined to a short length of the strip material at any given time. As illustrated in FIG. 9, the elongate forming body or die 50 is shown to be in line contact with the forming surface 28 of the connector clamps 58 and 60, the entire flexible die becomes bent along its entire length, thus causing the strip stock confined therein to also be bent along its entire length. Spreading of bending along the entire length of the strip stock in this manner induces minimal work hardening as compared to roll bending processes. The minimal work hardening that results enables reworking of the material by additional bending until bending has reached perfection.

Another advantage of the elongate polymer strips forming die strip elements 108, 110, 112 and 114 is the self-lubricating quality of the flexible strip material. Thus, as bending of the elongate flexible forming body or die occurs, slippage between the various strips occurs and slippage also occurs between the die forming strips and the strip stock. The self-lubricating quality of the die forming strips allows this type of slippage to occur under the high pressure of confinement and yet assures against any abrasion of the painted surfaces of the strip stock which are of themselves smooth. When the strip forming process has been completed, the resulting painted surfaces of the strip stock appear as if they had been painted in the curved configuration thereof. There is only slight almost unnoticeable distortion of the finished surface as the result of the molecular metal displacement that occurs during the forming process. Thus, tight and dense paint cannot buckle.

Figure 6:
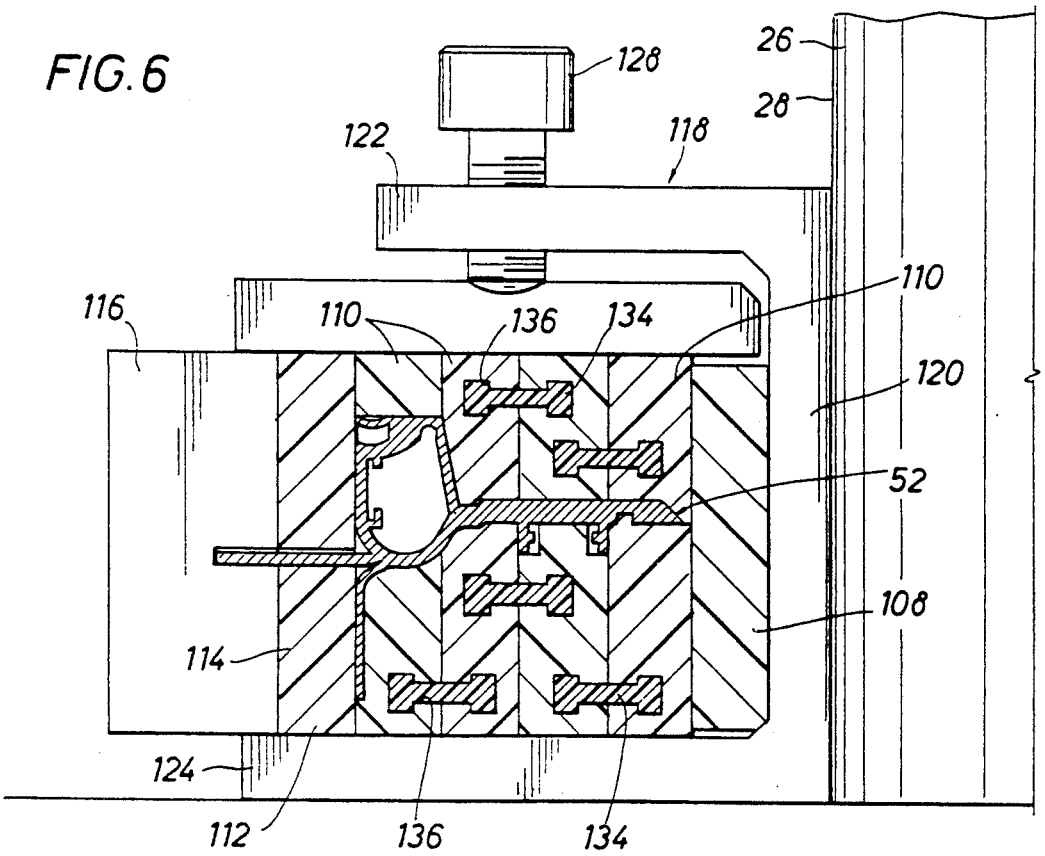

Referring now to FIG. 6, an alternative embodiment of the present invention is shown. Like components are represented by like reference numerals since many components of the elongate flexible die assembly shown in FIG. 6 are identical to that shown in FIG. 5. To facilitate ease of assembly of the elongate flexible forming body, it is desirable that the upper and lower sets of die strips be secured in assembly. This feature is accomplished by providing a plurality of elongate splines 134 which are positioned within correspondingly configured spline receptacles 136. The splined receptacles are jointly formed by machined or otherwise formed recesses in adjacent die strips. Although the splines 134 are shown to be of generally H-shaped configuration are received within correspondingly configured splined receptacles, this particular spline configuration is not intended to be limiting of the present invention. Any other character of splines may be employed so long as they function to secure the die strips in assembly. The elongate die strip bundles can therefore be easily assembled about the strip stock prior to the bending process and easily separated from the bent strip stock after the forming process has been completed. This feature also provides for enhanced production by saving the labor that would otherwise be required to carefully assemble all of the die strips about the strip stock and then assemble the clamps to complete the flexible die assembly.

The splined members 134 may be composed of any of a number of materials including polymer materials such as polyethylene or ultra high molecular weight polyethylene, spring steel, rubber, etc. It is only necessary that the splined members 134 be capable of bending along with the flexible die strips without inducing any permanent distortion into the flexible die. For purposes of this invention, it has been determined that splines of the configuration shown and composed of ultra high molecular weight polyethylene function quite well for the purposes intended.

In view of the foregoing, it is evident that the present invention is one well adapted to attain all of the objects and features hereinabove set forth, together with other objects and features which are inherent in the apparatus disclosed herein.

As will be readily apparent to those skilled in the art, the present invention may be produced in other specific forms without departing from its spirit or essential characteristics. The present embodiment, is therefore, to be considered as illustrative and not restrictive, the scope of the invention being indicated by the claims rather than the foregoing description, and all changes which come within the meaning and range of the equivalence of the claims are therefore intended to be embraced therein.

What is claimed is:

1. A method for achieving controlled bending of elongate strip stock about a forming substrate to a predetermined curvature and configuration, comprising:

(a) confining said strip stock along substantially the entire length thereof within an elongate flexible forming body having a length sufficient to accomodate that portion of said elongate strip stock that is intended to be bent and defining an elongate internal die cavity within which said strip stock is received, said confining being upwardly, downwardly, and on the side thereof intended to acquire a concave curvature upon bending; and (b) forming said elongate flexible forming body and said confined strip stock therein about said forming substrate thus causing said strip stock to assume a curved configuration as determined by said forming substrate.

2. The method of claim 1, wherein said confining step comprises:

(a) placing said elongate strip stock within said internal die cavity defined by said elongate flexible forming body; and (b) securing said elongate flexible forming body along substantially the entire length thereof in intimate, restraining engagement with said elongate strip stock.

3. The method of claim 2, wherein said forming step further comprises:

(a) attaching pulling elements to each extremity of said elongate forming body;

(b) securing said pulling elements to a tractor;

(c) orienting said pulling elements to enable a desired range of pulling angle relationships of said pulling elements with said elongate forming body; and (d) moving said tractor in a desired direction to bend said elongate flexible forming body with said elongate strip stock confined therein into conforming relation with said forming substrate.

4. The method of claim 1, wherein said forming step comprises:

applying lateral force to each extremity of said elongate flexible forming body thus forcing said elongate flexible forming body to conform to a configuration determined by said forming substrate.

5. The method of claim 1, including:

(a) subsequent to said forming step, changing the configuration of said forming substrate; and (b) forcing said elongate flexible forming body with said confined strip stock therein to assume the configuration of the forming substrate of changed configuration to further form said elongate strip stock.

6. A method of twist and wrinkle resistant forming of strip stock to a desired curved configuration, comprising:

(a) providing a bending substrate having a forming surface of a desired curved configuration;

(b) encapsulating said strip stock in a flexible forming body composed of flexible and substantially incompressible material, said flexible and substantially incompressible material forming an elongate die cavity having a cross-sectional configuration substantially conforming to the cross-sectional configuration of said metal strip stock;

(c) restraining lateral movement of said strip stock along substantially the entire length thereof; and (d) bending said flexible forming body with said strip stock in said elongate die cavity thereof about said forming surface of said bending substrate while maintaining said lateral restraining of said metal strip stock.

7. The method of claim 6, wherein said flexible forming body is composed of a plurality of elongate strips of said flexible and substantially incompressible material being disposed in face to face abutting relation and collectively forming said elongate die cavity, said encapsulating of said method including:

(a) placing said elongate strips of said flexible and substantially incompressible material in assembly about said strip stock; and (b) securing said elongate strips of said flexible and substantially incompressible material in intimate surface to surface supporting engagement with said strip stock to minimize separation thereof during said bending.

8. The method of claim 7, including;

prior to said bending, providing structural confinement for at least three sides of said flexible forming body.

9. The method of claim 7, including:

prior to said bending, providing structural support for the top, bottom and inside surfaces of said flexible forming body.

10. The method of claim 7, wherein said flexible forming die defines top and bottom generally parallel surfaces, an inside surface for facing relation with said substrate and an outside surface for facing away from said substrate, said inside surface being disposed in substantially normal relation with said top and bottom surfaces, said method including:

prior to said bending, bringing said top, bottom and inside surfaces into supported engagement with respective top, bottom and inside structural supports thus providing structural support for said flexible forming body along the length thereof.

11. The method of claim 8 wherein said flexible forming die defines top and bottom portions, an inside portion for facing relation with said forming substrate and an outside portion for facing away from said forming substrate, said securing comprising:

placing a plurality of clamps about said flexible forming body, said clamps providing structural support for said top, bottom and inside portions of said flexible forming body during bending of said flexible forming body and said strip stock in said elongate die cavity thereof.

12. A method of twist and wrinkle resistant forming of strip stock to a desired curved form and configuration, comprising:

(a) providing a forming substrate defining a desired curved form and configuration;

(b) confining said strip stock in an elongate flexible forming body extending along substantially the entire length thereof and being composed of flexible and substantially incompressible material having an elongate die cavity therein defining a cross-sectional configuration substantially conforming to the cross-sectional configuration of said strip stock, said elongate flexible forming body restraining uncontrolled movement of said strip stock upwardly, downwardly and inwardly toward said forming substrate at all times during the bending thereof;

(c) maintaining said surfaces forming said elongate die cavity of said elongate flexible forming body in supporting engagement with said strip stock along substantially the entire length thereof during said bending and forming of said strip stock; and (d) bending said elongate flexible forming body having said confined strip stock therein about said forming substrate, whereby said strip stock is bent to a configuration determined by said forming substrate.

13. The method of claim 12, wherein said elongate flexible forming body is composed of a plurality of elongate strips of flexible and substantially incompressible material being formed for collectively defining said elongate die cavity, said positioning of said method including;

(a) positioning said plurality of elongate strips of flexible and substantially incompressible material in assembly about said strip stock; and (b) securing said plurality of elongate strips of flexible and substantially incompressible material and thus said strip stock against movement upwardly, downwardly and toward said forming substrate at all times during said bending and forming of said strip stock.

14. Apparatus for forming strip stock to a desired curvature and configuration, comprising:

(a) support means;

(b) a forming substrate being removably fixed to said support means;

(c) an elongate flexible die composed of at least one elongate strip of flexible material having a length sufficient to accommodate that portion of said strip stock that is intended to be bent and defining at least one elongate die cavity therein of a cross-sectional configuration substantially conforming to the cross-sectional configuration of said strip stock, said elongate flexible die providing restraining contact with said strip stock along substantially the entire length thereof; and (d) means for imparting bending force to said elongate flexible die and forming said elongate flexible die to said forming substrate, thus forming strip stock restrained therein to a predetermined curvature and configuration.

15. The apparatus of claim 14, wherein said elongate flexible die comprises:

(a) at least two elongate strips of flexible material being formed such that in assembly said elongate strips of flexible material cooperatively form said elongate die cavity; and (b) means for securing said elongate strips of flexible material in restraining assembly with any strip stock located within said elongate die cavity during bending thereof to said desired curvature and configuration.

16. The apparatus of claim 14, including:

means externally of said elongate flexible die for retaining said elongate flexible die against lateral displacement and for permitting longitudinal flexing of said elongate flexible die to thus permit controlled bending and forming of said elongate strip stock.

17. The apparatus of claim 16, wherein said elongate flexible die comprises:

at least two elongate strips of flexible and substantially incompressible material being formed such that when in assembly said elongate strips define said elongate die cavity and to permit said elongate strips to be placed in assembly about said strip stock.

18. The apparatus of claim 16, wherein said means externally of said elongate flexible die comprises:

restraint means for releasable positioning in supporting relation about said elongate flexible die and providing intimate restraining engagement therewith.

19. The apparatus of claim 14, wherein said elongate flexible die comprises:

(a) a plurality of elongate die strips composed of flexible and substantially incompressible material being formed along the length thereof to define said elongate die cavity when said elongate die strips are positioned in assembly; and (b) an elongate inner laminant strip composed of flexible and substantially incompressible material being positioned in assembly with said elongate die strips, said elongate inner laminant strip defining the inner curvature of said elongate flexible die and providing sufficient beam strength to ensure continuity of inner curvature of said strip stock.

20. The apparatus of claim 19, including:

a removable segmented rigid external case containing said elongate die strips and said inner laminant strip and preventing lateral movement thereof during bending of said elongate flexible die.

21. The apparatus of claim 20, wherein said segmented rigid external case comprises:

a plurality of rigid clamps being positionable in closely spaced relation along the length of said elongate flexible die and providing said elongate die strips and said inner laminant strip with rigid support against lateral movement.

22. The apparatus of claim 21, wherein each of said clamps comprises:

(a) a clamp body;

(b) a clamp plate;

(c) means securing said clamp plate in movable clamping assembly with said clamp body; and (d) said clamp body and clamp plate providing support for said elongate flexible die along at least three axes.

23. The apparatus of claim 19 including:

means for securing said elongate die strips in grouped assembly when said segmented rigid external case is removed.

24. The apparatus of claim 14, wherein said means for imparting bending force to said elongate flexible die comprises:

(a) a tractor being movably supported by said support means and being movable linearly thereon;

(b) motor driven means having driving connection with said tractor; and (c) means for operably connecting said tractor to respective end portions of said elongate flexible die for bending said elongate flexible die to a predetermined configuration determined by the configuration of said substrate.

25. The apparatus of claim 24, wherein:

said operably connecting means comprises a force applying bridle connecting respective ends of said elongate flexible die to said motor operated linearly movable tractor.

26. An elongate flexible forming body for controlled bending of strip stock, comprising:

(a) a plurality of elongate die strips composed of flexible and substantially incompressible material and being formed along the length thereof such that said elongate die strips, when in assembly, collectively define an elongate die cavity of a configuration substantially conforming to the configuration of the strip stock to be bent;

(b) an elongate inner laminant strip composed of flexible and substantially incompressible material and being positionable in assembly with said elongate die strips, said laminant strip defining the inner curvature of said elongate flexible die and providing sufficient beam strength to ensure continuity of curvature of said strip stock; and (c) a segmented external case being removably positionable in transversely restraining assembly about said elongate die strips and said elongate inner laminant and providing transverse restraint therefor during bending of said elongate flexible die and the strip stock contained within said elongate die cavity.

* * * * *